US005381947A

United States Patent [19]

Steidinger

[11] Patent Number: 5,381,947

[45] Date of Patent: Jan. 17, 1995

[54] WINDOW-EQUIPPED MAILER AND METHOD

[75] Inventor: Donald J. Steidinger, Barrington, Ill.

[73] Assignee: Tamarack Products, Inc., Wauconda, Ill.

[21] Appl. No.: 87,204

[22] Filed: Jul. 2, 1993

[51] Int. Cl.[6] ..... B65D 27/04

[52] U.S. Cl. ..... 229/71; 229/69

[58] Field of Search ..... 229/71, 69

[56] References Cited

U.S. PATENT DOCUMENTS 3,104,799 5/1961 Steidinger .
3,312,385 4/1965 Amort .
3,325,188 10/1965 Hiersteiner .
4,095,695 6/1978 Steidinger .
4,705,298 11/1987 Van Malderghem et al. .
5,125,563 6/1992 Lombardo ..... 229/71

FOREIGN PATENT DOCUMENTS 2175250 11/1986 United Kingdom ..... 229/71

*Primary Examiner*—Allan N. Shoap
*Assistant Examiner*—Jes F. Pascua
*Attorney, Agent, or Firm*—Tilton, Fallon, Lungmus & Chestnut

[57] ABSTRACT

A window-equipped mailer and method of making in which the window is covered by a translucent or transparent covering and wherein this covering has a transverse edge aligned with a transverse edge of an inner ply.

1 Claim, 3 Drawing Sheets

WINDOW-EQUIPPED MAILER AND METHOD

BACKGROUND OF THE INVENTION

1. Field of the Invention

This invention relates to mailer forms, and, more particularly, to mailer forms using a window with transparent or translucent covering.

2. Description of the Prior Art

Multiple ply mailer forms, i.e., stuffed sealed envelope assemblies, utilizing plies for the face and back of the outgoing envelope and inside plies cut to a smaller size to facilitate gluing of the envelope outer plies along the edges to form a sealed mailing piece are well known in the art. My U.S. Pat. Nos. 3,104,799 and 4,095,695 exemplify this prior art. Exemplary of stuffed sealed envelope assemblies with windows are U.S. Pat. Nos. 3,312,385; 3,325,188; and 4,705,298 but none have window coverings.

SUMMARY OF THE INVENTION

Typically the prior art used an "outside ply" above the face of the mailer envelope to facilitate the separation of the data that was to appear on the envelope face, i.e., the recipient name and address, from the confidential information inside the mailer by use of spot carbon patterns. The outside ply was removed before mailing and used effectively as a file copy and for follow-up.

As computer systems are developing, they increasingly use computer memory for file and follow-up so the outside ply is no longer needed. Often it is thrown away after the computer printing of the mailer, having completed its function of separating the data that is to appear on the face and interior of the mailer.

One solution, suitable when no "outside" file copy is needed, is to provide a window in the face of the mailer envelope and to utilize a "self-contained" imaging paper ply inside the mailer. A self-contained paper contains both imaging components so an impact will form the character image. This is in contrast to coated face (CF) and coated back (CB) imaging papers, such as those available from Appleton Paper Co., Appleton, Wis. 54912.

In many cases, it is desired to cover the window with a transparent or translucent material, i.e., a window covering. Therefore, it is an object of the invention to provide a mailer form with a window and window covering. Another object of this invention is to provide a method of manufacture of mailers with windows and window covering.

Briefly described, the invention adds the window covering material to the mailer envelope ply by introducing the covering in a conventional mailer collator as a continuous ply at the same rate of speed as one or more of the other plies. This covering ply is assembled over the other inside plies and is cut to the length (in machine direction) of the inside plies and glued to the inside surface of the envelope front.

Even more advantageously, the covering material can be introduced on the mailer collator at a rate of speed that is less than the speed of the other plies with the result that it is cut shorter in length than other inside plies, thus using only as much window covering material as is required to cover the window opening.

BRIEF DESCRIPTION OF DRAWING

The invention is described in conjunction with the accompanying drawing, in which.

DETAILED DESCRIPTION

Figure 1:
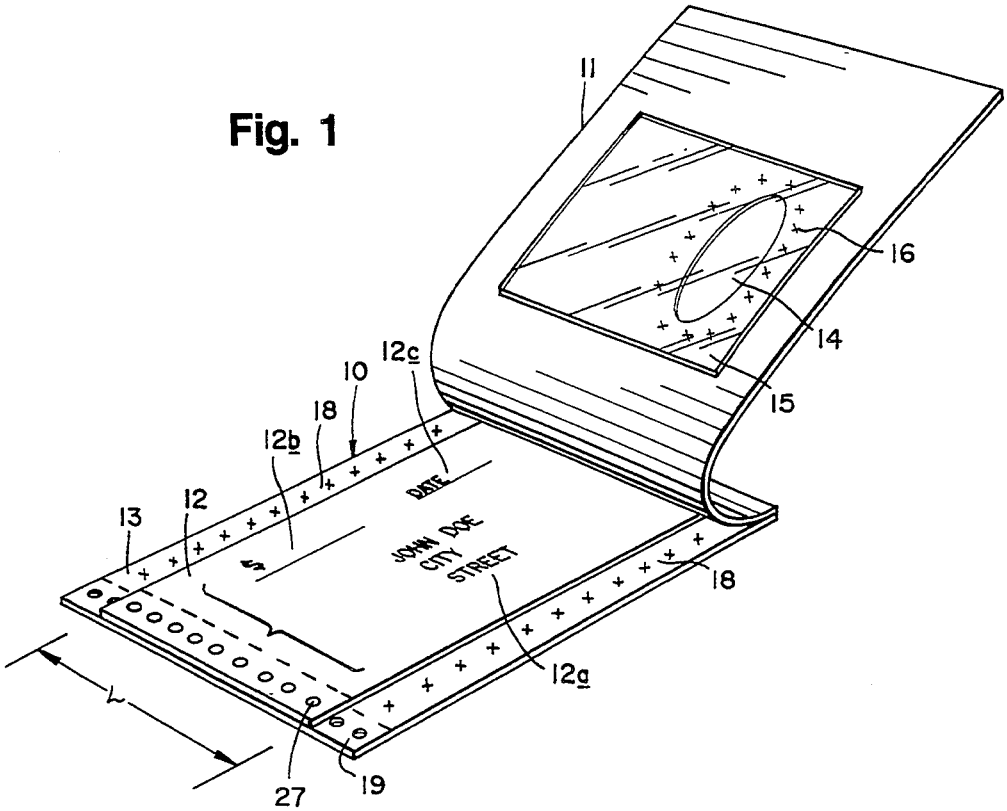
FIG. 1 is a perspective view of an embodiment of the invention with portions of the various plies separated to illustrate the invention.

Referring now to FIG. 1, the numeral 10 designates generally a completed mailer assembly constructed according to the teachings of this invention. As illustrated, the mailer assembly 10 includes an envelope outer ply providing the front 11, an insert or inside ply 12 and a second outer ply providing the envelope back 13. It will be immediately appreciated that different numbers of inside plies 12 can be employed and that the single inside ply 12 is illustrated merely for the same of convenience and clarity.

The envelope front 11 has window opening 14 typically to expose the recipient address **12*a* appearing on inside ply 12. Translucent or transparent window covering 15 is fastened to the bottom surface of envelope front 11 by a glue pattern 16. In this first embodiment, the length of window covering is equal to the length L of the inside ply 12**.

Illustrative of a translucent material is a paper treated with oil or wax to render the same semi or partially transparent. Transparent materials are typically the plastic films. A transparent film suitable for the practice of the invention is No. 516 Polyester from Plastic Suppliers, Chicago Heights, Ill. 60411. A translucent glassine is also suitable in the form of 22# Escovue from Robert Williams Company, Atlanta, Ga. 30346.

The inside ply 12 advantageously may be a self-contained carbonless paper such as Self Image Paper of 3M Company, Carbonless Products Department, St. Paul, Minn. 55144. The mailer is printed using an impact printer using no ink ribbon. The impact makes the total image on ply 12 including entries at **12*b* and 12*c* as well as 12*a*. Only the address portion 12*a* shows through the window 14 but the confidential information, typically a billing remains confidential under the envelope front 11**.

Figure 2:
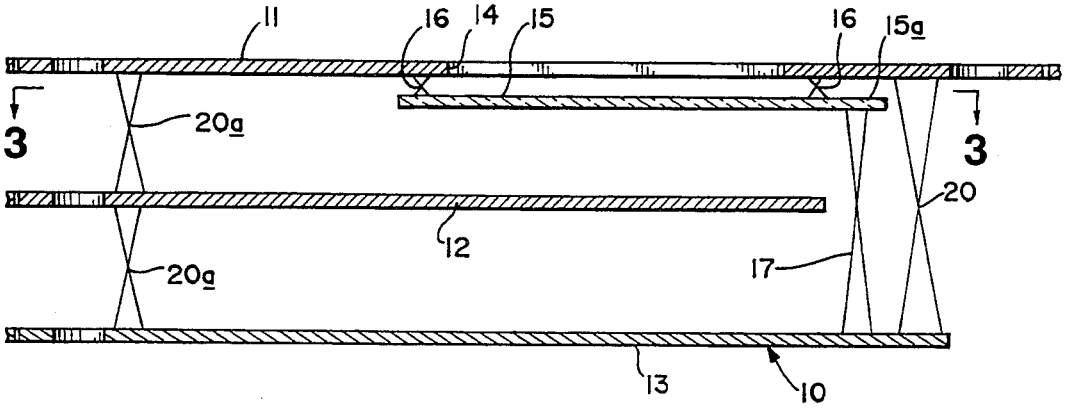
FIG. 2 is a schematic cross section view of a mailer form in the condition it exists prior to computer printout.

Referring to FIG. 2, the same plies 11, 12, 13, 15 are shown. The window covering ply 15 is shown extending beyond the right edge of ply 12. This allows the use of glue line 17 to fasten covering ply 15 to back ply 13 for more secure control during manufacture if desired. Covering ply 15 need not extend to the right edge or beyond inside ply 12 if this is not convenient because in the finished mailer, covering ply 15 is fastened by glue pattern 16 to the front ply 11.

The web which provides the inside ply 12 is transversely severed incident to being laid down on the web providing the envelope back 13 to reduce the length of inside ply 12. By "length", I refer to the direction the webs are advanced in the collator, i.e., the direction in which the control punch margins 19 extend.

This shortening of the ply 12 enables glue lines 18 to fasten the envelope front 11 and envelope back 13 together. Longitudinal adhering is provided along one margin by the glue line 20—see the right side of FIG. 2. In some instances, I employ the adhesive arrangement of 20a at the left side of the assembly 10 of FIG. 2. There the margin of the inside ply 12 is adhered between the margins of the outer plies 11 and 13. In other instances, there may be no adhering of the inside ply to the outer plies. In this embodiment, the window covering web is cut to the same length as the inside ply 12—see FIG. 3.

Figure 3:
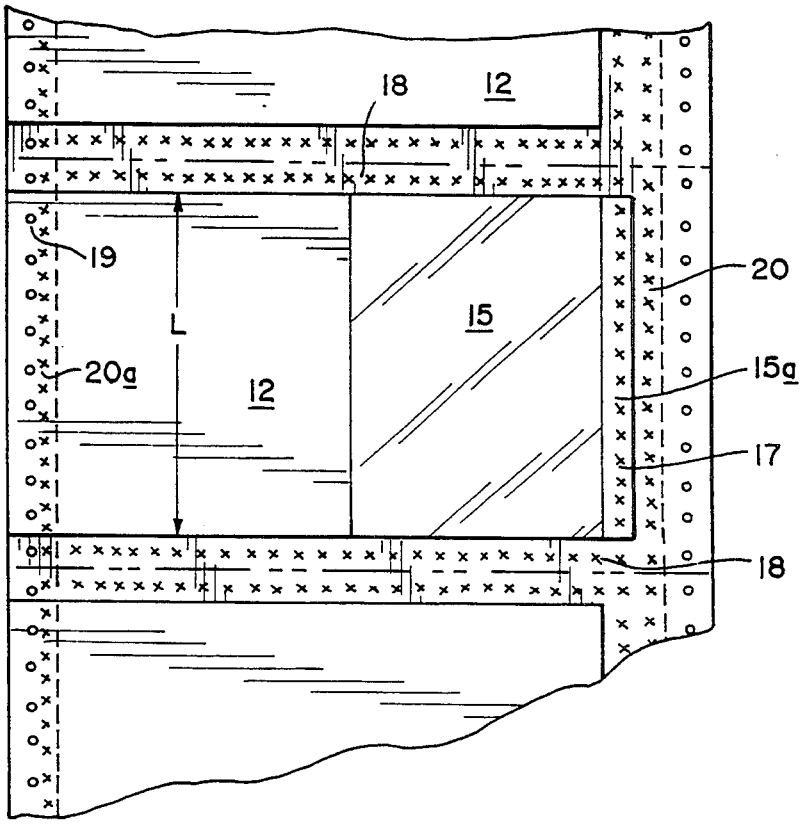
FIG. 3 is a fragmentary section view such as would be seen along the sight line 3—3 of FIG. 2.

FIG. 3 shows the window covering 15 lying over inside ply 12 and extending therebeyond on the right side as at 15*a* before the envelope front 11 is added to the assembly. This is also seen in FIG. 2. The length of the window covering 15 is the same length L as inside ply 12. The window covering 15 is cut to length at the same time as is the inside ply 12 so no additional machinery is needed to process the window covering 15. FIG. 3 shows the window covering 15 extending beyond (as at 15*a*) the right edge of inside ply 12 in order to use the glue line 17 to hold covering 15 during manufacture. Window covering 15 can also have a width which extends to the edge of inside ply 12 or be narrower than ply 12 and terminate short on one or both transverse edges of ply 12. Here, again, the term transverse is used in the context that longitudinal refers to machine direction, not the magnitude of the dimension.

Figure 4:
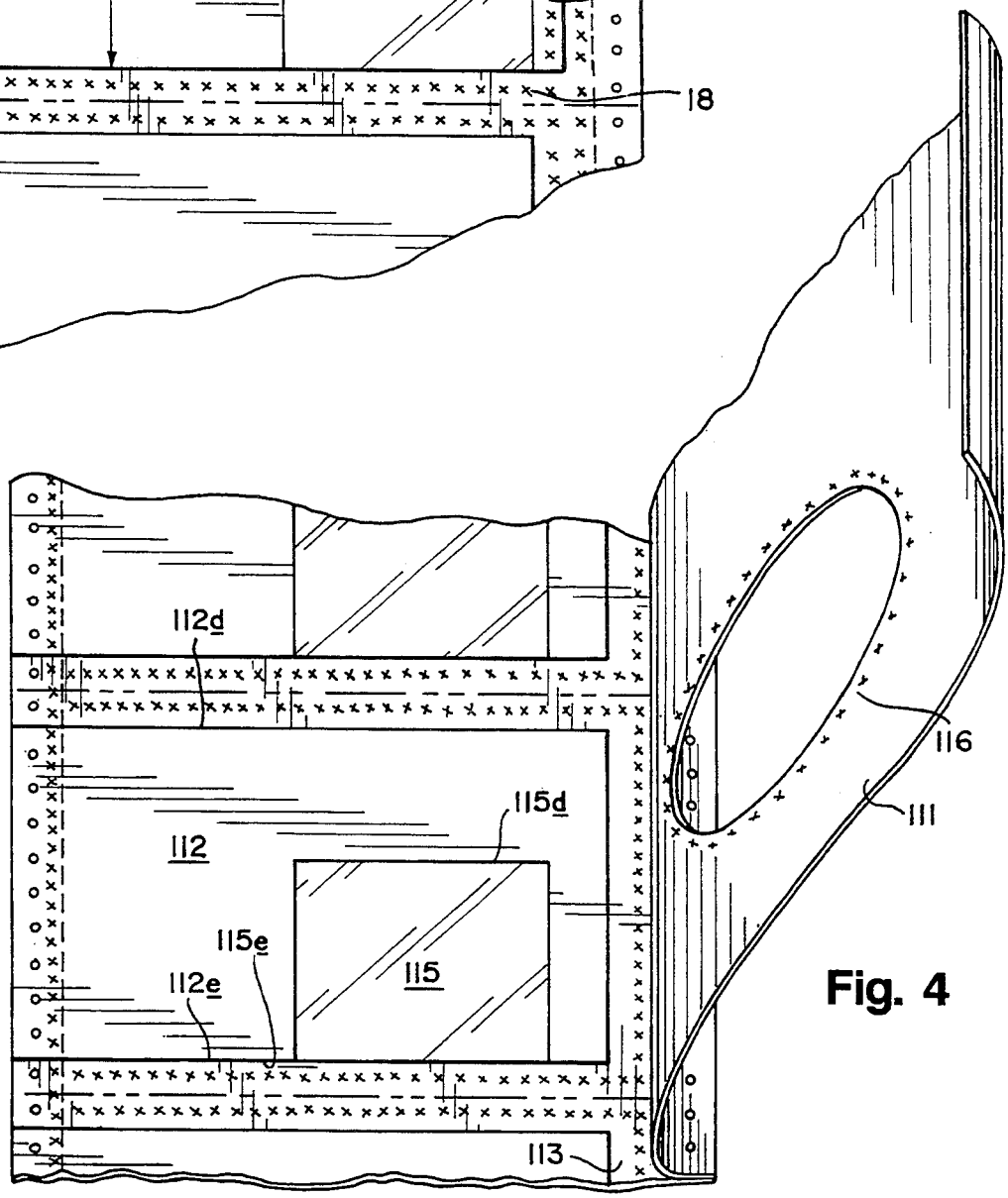
FIG. 4 is a fragmentary sectional view similar to FIG. 3 of a second embodiment of the invention.

Embodiment of FIG. 4

FIG. 4 discloses a second embodiment utilizing a reduced size window covering material 115 in order to make more economical use of this material. Again the front ply is 111 and the back ply 113. In this case, the width of material 115 is sufficient to accommodate the window and glue pattern 116 without substantial excess. The length of the window covering 115 extends toward the upper edge 112*d* of the inside ply 112 (as shown in FIG. 4) but only far enough as at 115*d* to cover the window opening 114 and glue 116. At the other end, the edge 115*e* of the covering 115 is aligned with the lower edge 112*e* of inside ply 112 as it is cut at the same time as inside ply 112. Essentially the other parts of the mailer of FIG. 4 are as described relative to FIG. 1.

Method of Manufacture

Figure 5:
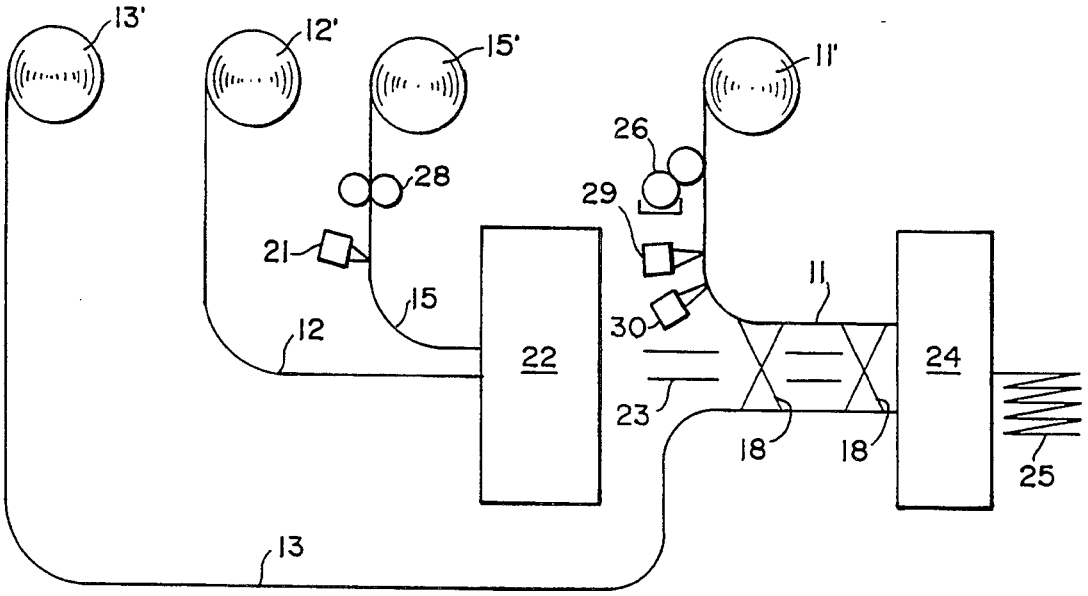
FIG. 5 is a schematic side elevational view of apparatus employed in the manufacture of the mailer form of FIG. 3.

The method for making the mailer of FIG. 3 is illustrated schematically with reference to FIG. 5. At the extreme left of FIG. 5, the numeral 13' designates a parent roll from which is unreeled the web ultimately constituting the envelope back 13 of the mailer forms. Parent roll 12' provides the inside ply 12 and parent roll 11' provides the envelope front 11.

Parent roll 15' provides the window covering material 15 which is typically narrower than the other plies and does not need pin feed holes as do the other plies as used on rolls 11', 12' and 13' inasmuch as there is not the accurate registration requirements for the window covering material 15 as is required on the other plies. Ply 15 can be collated as a "carbon ply" as is well known in the art. If ply 15 is to be provided with glue line 17, it can be provided by glue nozzle 21.

The webs 12 and 15 are transversely severed simultaneously by means of a cutoff device 22 and, incident to the cutoff, are positioned as a stack of plies 23—see the right central portion of FIG. 5. Thereafter, the envelope fronts are provided from a parent roll 11'. The thus-assembled webs are sent through a cross perforator 24 and thereafter zig-zag folded as at 25.

In the illustration given in FIG. 5, an adhesive applying device generally designated 26 is employed to lay down the transverse bands of adhesive 18 and window covering glue pattern 16.

Figure 6:
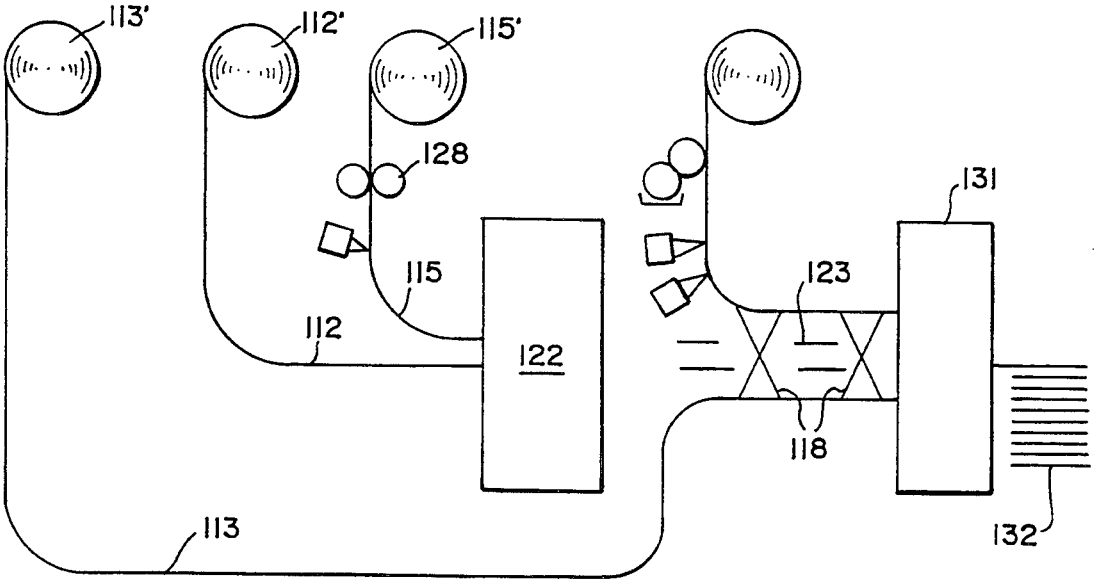
FIG. 6 is a view similar to FIG. 5 but of apparatus for manufacturing the form of FIG. 4 wherein the window covering is shorter than it is in FIG. 3.

Thus, in the practice of the invention, an envelope bottom 13 is unrolled from parent roll 13'. At least one inside ply 12 is unwound from roll 12' and an envelope front 11 is unwound from roll 11'. The plies 11, 12 and 13 are aligned with each other using line holes 27 (see FIG. 1) which extend in the machine direction as is well known in the art. Window covering material 15 is unwound from roll 15' and fed via feed rolls 28 as a carbon ply, i.e., without the use of line holes and at the same speed as inside ply 12. The webs 12 and 15 are cut to a length shorter than plies 11 and 13 by means of a cutoff device 22. Plies 12 and 15 are laid down on ply 13 and covered by ply 11 which has the window opening 15. The glue apparatus 26 is used to apply the transverse glue lines 18 and window covering glue pattern 16. Nozzles 29, 30 apply longitudinal glue lines 20 and 20*a* in a conventional manner. The assembled mailers are then most commonly cross perforated at 24 and zig-zag folded as illustrated at 25. They could also be cut off and collected as individual cut mailers, particularly when the mailers are "fulfilled", i e when the mailer is computer printed at the time of manufacture. The mailer shown in FIG. 4 is made in a very similar way—see FIG. 6 where like numbers are used except being increased by 100. The window covering 115 is unwound from roll 115' at a rate slower than insert ply 112 (from roll 112') by use of feed rollers 128. Thus, when cutoff device 122 cuts plies 112 and 115 the covering material is shorter in length than inside ply 112—compare the showing 123 between glue lines 118. The cutoff device cuts both ply 112 and 115 at the same time so one transverse edge 115*e* of ply 115 is generally aligned with one corresponding edge 112*e* of 112 shown in FIG. 4 as the lower edge. Thus, material savings of window covering material can be achieved by changing only the speed of feed rolls 128.

In the practice of the invention, the transverse edges as at 112*e* and 115*e* are generally aligned as a consequence of having been developed simultaneously through the operation of the cutting device 122. However, it is not essential to the practice of the invention that they be maintained in this relationship when they are positioned between the outer plies 111, 113. For example, in the typical mailer, the window covering ply 115 could move up or down about ¼" (6 mm) without detracting from the advantageous operation of the invention.

The invention also contemplates the provision of individual mailers as would be obtained in providing a sheeter 131. In the business form parlance, a sheeter operates to cut a web or webs into a sheet or sheets which may be bound or unbound. This results in a stack of mailers as at 132 in the left hand portion of FIG. 6.

While in the foregoing specification a detailed description of the invention has been set down for the purpose of illustration, many variations in the details hereingiven may be made by those skilled in the art without departing from the spirit and scope of the invention.

I claim:

1. A mailer form having separate mailer front and back generally rectangular outer plies and at least one inside ply, each of said plies having a pair of longitudinally extending edges defined by the direction of movement during mailer collation and a pair of transverse edges perpendicular to said longitudinal edges, said outer plies each having inner and outer surfaces and being adhesively united about the perimeter thereof, an outer ply being provided with a window opening, said window opening ply being covered on its inner surface with a covering material at least translucent and having a length up to that of said inside ply and having one transverse edge generally aligned with the transverse edge of said inside ply, said covering material having inner and outer surfaces, adhesive being interposed between said inner surface of said covering material and said back outer ply along one longitudinally extending edge of said covering material.

* * * * *